US005180109A

United States Patent [19]

Schwartzbauer et al.

[11] Patent Number: 5,180,109

[45] Date of Patent: Jan. 19, 1993

[54] SINGLE USE SPRAY DISPENSING ASSEMBLY

[75] Inventors: Neil J. Schwartzbauer, Hastings; Douglas J. Laska, Maplewood, both of Minn.

[73] Assignee: Minnesota Mining and Manufacturing Company, St. Paul, Minn.

[21] Appl. No.: 710,688

[22] Filed: Jun. 5, 1991

[51] Int. Cl.[5] ..... B05B 7/30

[52] U.S. Cl. ..... 239/346; 239/369; 222/147; 222/637

[58] Field of Search ..... 239/346, 318, 310, 340, 239/369; 222/147, 630, 637

[56] References Cited

U.S. PATENT DOCUMENTS

| | | | |
|---|---|---|---|
| 2,090,977 | 8/1937 | Hoffmann | 225/22 |
| 2,101,471 | 12/1937 | Greenbaum | 225/22 |
| 3,386,664 | 6/1968 | Knibb | 239/346 |
| 3,730,392 | 5/1973 | Marand | 222/82 |
| 3,993,250 | 11/1976 | Shure | 239/332 |
| 4,220,285 | 9/1980 | Gualdi | 239/309 |
| 4,377,244 | 3/1983 | Rossetti | 220/268 |
| 4,653,676 | 3/1987 | Stull | 222/566 |
| 4,723,684 | 2/1988 | Lambert et al. | 220/268 |
| 4,767,058 | 8/1988 | LaRosa et al. | 239/309 |
| 4,781,329 | 11/1988 | Tenney et al. | 239/346 |
| 4,804,144 | 2/1989 | Denman | 239/346 |
| 4,936,511 | 6/1990 | Johnson et al. | 239/346 |
| 4,969,603 | 11/1990 | Norman | 239/318 |
| 4,971,224 | 11/1990 | Scremin | 222/3 |
| 4,971,251 | 11/1990 | Dobrick et al. | 239/346 |
| 4,976,368 | 12/1990 | Klein | 220/268 |

*Primary Examiner*—Andres Kashnikow
*Assistant Examiner*—Karen B. Merritt
*Attorney, Agent, or Firm*—Gary L. Griswold; Walter N. Kirn; James D. Christoff

[57] ABSTRACT

A disposable spray dispensing assembly for liquid materials includes a container that comprises an aerosol can, and a spray head initially detached from the container. A cap is connected to the container and includes a central recess extending into the chamber and presenting a hole. A tube within the chamber is connected to a cylindrical wall surrounding the recess. The cap is non-releasably connected to the container and hinders refilling of the chamber in order to reduce the likelihood that the chamber might contain a material different than the contents indicated on the container's label.

19 Claims, 2 Drawing Sheets

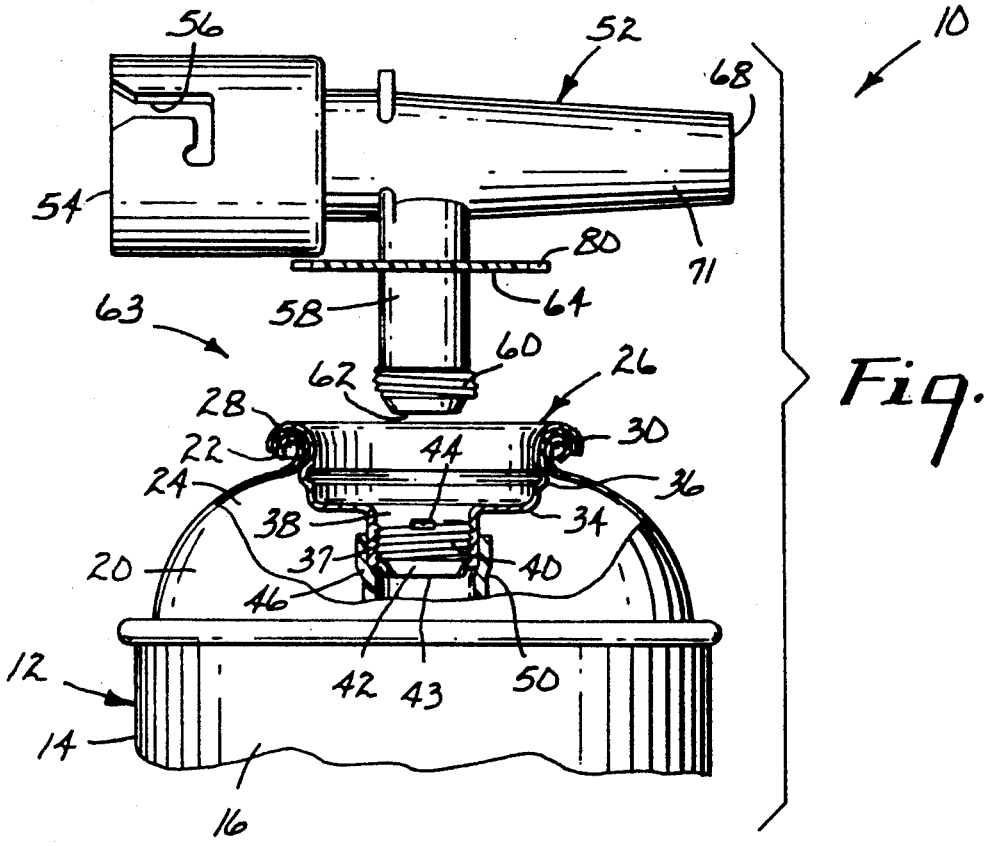
Fig. 2
Fig. 3
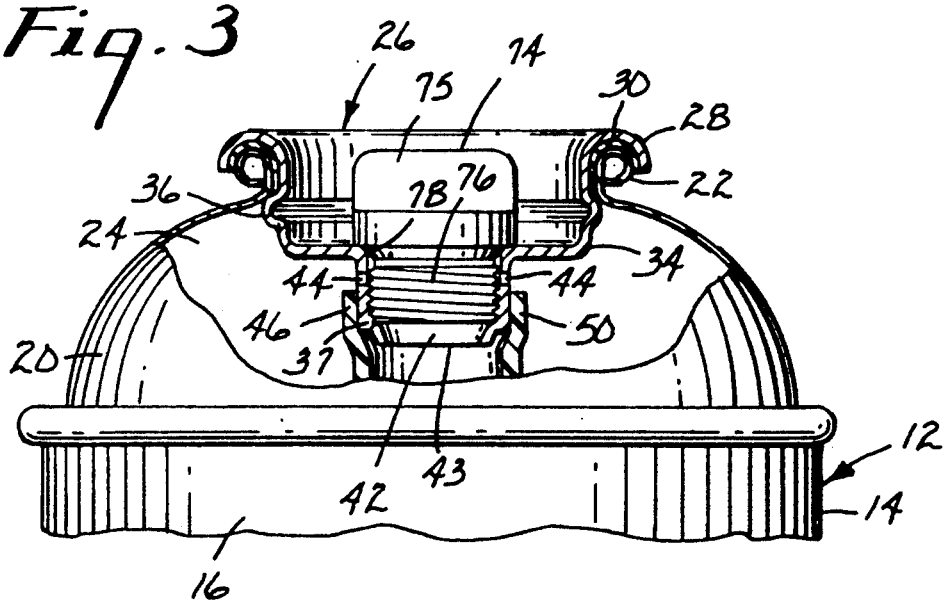

SINGLE USE SPRAY DISPENSING ASSEMBLY

BACKGROUND OF THE INVENTION

1. Field of the Invention

This invention relates to a disposable, single use spray dispensing assembly adapted for detachable connection with a source of pressurized air for applying liquid material such as adhesives, coatings, sealants, solvents, penetrants, lubricants and the like.

2. Description of the Related Art

Conventional pressurized air spray dispenser assemblies for spraying liquid material often include a spray head having a control valve, and a container releasably connected to the spray head. Typically, the container is filled by the user with liquid material from a larger, bulk container. Next, the spray head is connected to the container as well as an air hose. After the spraying operation, the spray head is detached from the hose and the container is detached from the spray head, and often both the spray head and the container are then cleaned i preparation for the next spray operation.

Spray heads associated with conventional spray dispensing assemblies have relatively small passageways that are difficult to clean when used with certain material. Solvents may be used in some instances for cleaning, but many solvents are relatively expensive, hazardous and present disposal problems. Moreover, it is often difficult, if not impossible, to reuse conventional spray assemblies for spraying certain liquids such as adhesives that cure and cannot be subsequently removed by solvents.

U.S. Pat. No. 4,804,144, dated Feb. 14, 1989, describes a spray dispenser apparatus that includes a eductor assembly having a dip tube that extends into a screw top container. The eductor assembly, the container or both may be disconnected when desired from an air gun control handle for disposal. The container includes an upper threaded tubular projection initially sealed by a disk having a scored center portion that may be punched out for insertion of the dip tube and connection of the eductor assembly to the container.

However, the spray apparatus described in U.S. Pat. No. 4,804,144 is not entirely satisfactory when such a container is to be used as a shipping container for the liquid material and bears a label to identify the liquid contents, because of the possibility that the container may be refilled with another composition after dispensing the original contents. In such instances, the label no longer correctly identifies the contents of the container and may not sufficiently warn the operator of hazards associated with the new contents (a particular problem if the apparatus is used by more than one person). Further, if the container and the eductor assembly are not sufficiently cleaned between uses, the new liquid contents may be contaminated or react with small residual amounts of the liquid material that was originally packaged in the container.

U.S. Pat. Nos. 4,936,511 and 4,971,251, both of which are assigned to assignee of the present invention, describe a liquid spray gun assembly having a disposable, bag-like container that is non-releasably fixed to a spray nozzle assembly that, in turn, is adapted for detachable connection with a reusable air gun handle that includes a control valve. A rupturable barrier within the bag container prevents liquid materials from evaporating or leaking through the spray nozzle during transit. At the end of a work operation, the nozzle and attached bag container are removed from the handle and disposed, so that no cleaning is necessary.

However, shipping regulations in certain jurisdictions prevent or at least hinder shipping liquid material in bag-like containers if the liquid material include solvent or flammable compositions. Moreover, there is a continuing interest in reducing the expenses associated with spray nozzles and containers and the accompanying cost of filling the containers. As such, it is often prudent to consider the use of conventional liquid containers that are widely available and inexpensive to purchase and fill. Moreover, since the spray head is non-releasably fixed to the bag-like containers of the dispensing assemblies shown in U.S. Pat. Nos. 4,936,511 and 4,971,251, the entire assembly is typically disposed even when only a portion of the liquid contents in the bag have been dispensed once the material has set up or cured in the passages of the spray head.

SUMMARY OF THE INVENTION

The present invention concerns a spray dispensing assembly for liquid materials and comprises a container having a chamber with an opening. A captive cap is non-releasably connected to the container and extends across the opening, and the captive cap includes a hole. A spray head has a first inlet with a connection for detachable joining with a source of pressurized air, a second inlet for liquid material and an outlet for discharging a spray of liquid material. The assembly also includes a coupling for coupling the second inlet of the spray head to the captive cap next to the hole. A tube in the chamber has a first end portion located in the chamber at a position remote from the captive cap, and a second end portion fixed to the captive cap next to the hole.

At the end of a spraying operation, the container and the spray head may be removed as a single unit from the pressurized air source for simultaneous disposal. The position of the tube, extending from the hole of the cap to a remote position in the chamber, renders refilling of the container difficult and discourages its reuse. As a consequence, one can be assured that, in all likelihood, the label on the container correctly identifies the container's contents and that other material has not been added to or substituted for the original contents.

BRIEF DESCRIPTION OF THE DRAWINGS

FIG. 2 is a fragmentary, enlarged, side elevational view with parts broken away in section of the assembly shown in FIG. 1 except that a spray head and a container of the assembly are illustrated as detached from one another;

FIG. 3 is a fragmentary, enlarged side elevational view of the container shown in FIG. 2 along with a plug for initially closing the container.

DETAILED DESCRIPTION OF THE PREFERRED EMBODIMENT

Figure 1:
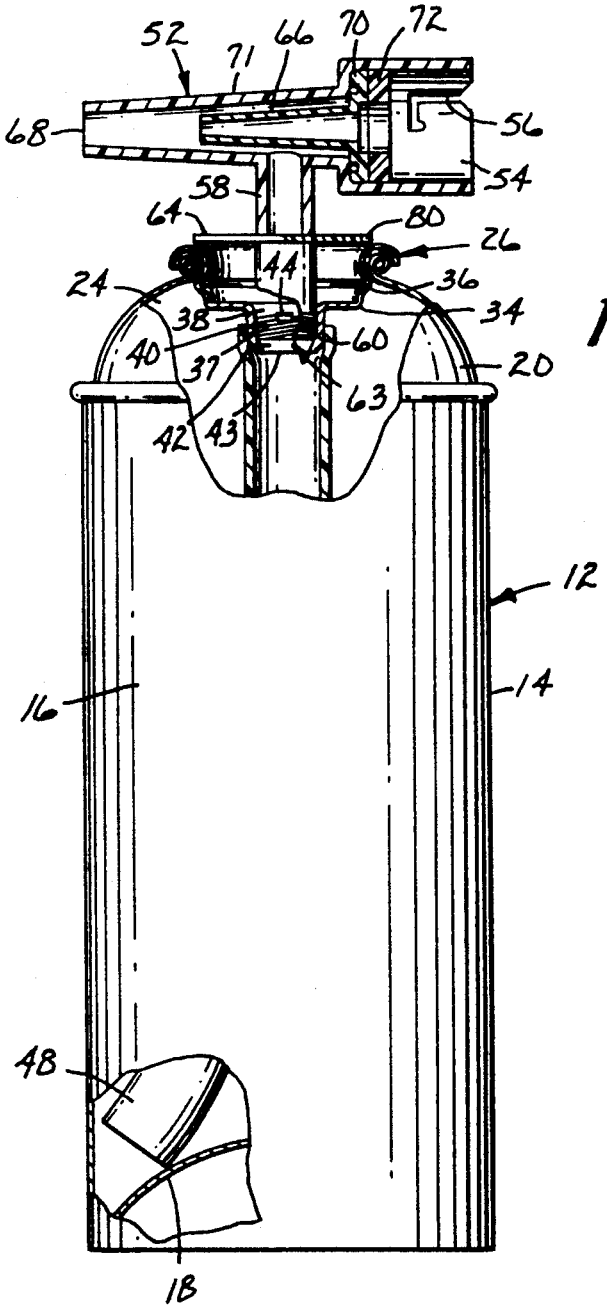
FIG. 1 is a side elevational view with parts broken away in section of a spray dispensing assembly constructed in accordance with the present invention.

A spray dispensing assembly 10 of the present invention includes, as shown in FIGS. 1–3, a container 12 that advantageously comprises an otherwise conventional, three-piece aerosol can 14 widely available in the industry and manufactured of tin-coated steel. The can 14 includes a cylindrical section 16 with a soldered side seam, a concave bottom 18, and a domed top 20 that is seamed in leak-free relation to the cylindrical section 16.

Figure 4:
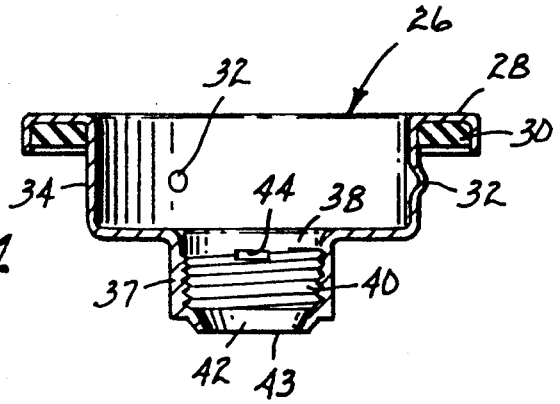
FIG. 4 is an enlarged side cross sectional view of a cap of the assembly shown in FIGS. 1–3 before assembly of the cap to the container.

The top 20 has an upper rolled-over flange 22 that presents an opening overlying an internal chamber 24 of the can 14. The opening, however, is closed by a captive cap 26 extending across the opening. The cap 26 (see also FIG. 4) has an upper, peripheral rolled flange 28 having a shape complemental to the shape of the flange 22. A buna-N synthetic rubber gasket 30, having a 70–80 durometer Shore A hardness, is placed within the flange 28 and is initially held in place by three dimples 32 (two of which are shown in FIG. 4) before assembly of the cap 26 to the can 14.

During assembly of the cap 26 to the can 14, an expandable collet is placed within a recessed, central cup 34 of the cap 26, and the collet is then radially expanded to form a peripheral crimp 36 (FIGS. 1–3) in the cylindrical sidewall of the cap 26 immediately below the flange 22. The cap 26 is made of 0.015 inch tin-plated steel, and the crimp 36 extends through the area where the dimples 32 were previously located, causing the dimples 32 to blend into the crimp 36 and effectively disappear.

A cylindrical depending wall 37 defining a recess 38 is located in the middle of the cup 34 and extends toward the chamber 24. The recess 38 has internal sidewall threads 40 (FIG. 2) that extend down to an inwardly-oriented shoulder 42 that, in turn, surrounds a hole 43. Two vents 44 spaced from the hole 43 extend through the sidewall of the recess 38 in a location just below the upper limit of the threads 40.

A suction tube 46 is located within the chamber 24 and has a lower first end portion 48 that extends to a location closely adjacent to (and normally contacts) the lower, peripheral region of the bottom 18 as shown in FIG. 1. An upper, second end portion 50 of the tube 46 covers the hole 43 and is fixed to the cylindrical wall 37. Preferably, the tube 46 is made from a synthetic resinous material such as polyethylene and has an inner diameter less than the diameter of the cylindrical wall 37 for press-fit engagement with the latter. Also, the tube 46 is preferably cut from roll stock, and as such has an inherent slight curvature to enable the first portion 48 to extend in curved fashion toward the lower, peripheral reaches of the chamber 24.

Referring now to FIGS. 1 and 2, a spray head 52 includes a tubular first inlet 54 having a cylindrical sidewall with opposed J-shaped channel connections 56 for detachable joining with a source of pressurized air. The channel connections 56 are adapted to receive respective, opposed pins of an air gun handle and thus provide a releasable bayonet or twist-lock coupling between the air gun handle and the spray head 52. The gun handle includes a trigger valve for controlling the flow rate of pressurized air directed into the first inlet 54. A representative handle is described in the aforementioned U.S. Pat. No. 4,936,511.

The spray head 52 is integrally molded of a synthetic resinous material and includes a depending, tubular body 58 that terminates in an externally threaded portion 60. The portion 60 surrounds a lower, second inlet 62 (FIG. 2) for admitting liquid material into the spray head 52. The threaded portion 60 together with the threads 40 comprise a coupling 63 for coupling the second inlet 62 to the hole 43. The body 58 is integrally connected to a circular plate 64 that extends in a plane perpendicular to the longitudinal axis of the body 58.

A venturi nozzle insert 66 (FIG. 1) directs pressurized air from the first inlet 54 toward an outlet 68. The flow of air through the insert 66 establishes negative pressure conditions in the tubular body 58 to draw in liquid material through the second inlet 62. The insert 66 has an endmost, annular flange 70 that is received in the cylindrical wall surrounding the first inlet 54, and functions to retain remaining portions of the insert 66 in spaced, coaxial alignment from a tubular, conical wall 71 leading to the outlet 68. A gasket 72 is adapted to sealingly engage the end of the detachable air gun handle.

Initially, the hole 43 is covered by closing means comprising a plug 74 (FIG. 3) having external threads 76 that mate with the threads 40 of the recess 38. The threads 76 extend a sufficient distance along the central axis of the plug 74 so that when the plug 74 is fully threaded into the threaded portion 60 as shown in FIG. 3, a portion of the threads 76 constitute structure to cover the vents 44 in order to retain liquid material in the chamber 24 as would be desirable, for example, during shipment of the container 12 and handling of the container 12 before use. A secondary seal 78 is established between a shoulder of the cup 34 at the top of the recess 38 and an outwardly chamfered wall of the plug 74 above the threads 76.

To begin a spray dispensing operation, the plug 74 is unthreaded from the cup 34 by grasping an upstanding, tab-like head 75 of the plug 74. The spray head 52 is then assembled to the container 12 by turning the threaded portion 60 into the threads 40 until the tubular body 58 is fully seated in the recess 38 as shown in FIG. 1. The vents 44 are open to the atmosphere when the threaded portion 60 is fully seated in the recess 38 due to the fact that the overall length of the threaded portion 60 in a direction along the longitudinal axis of the body 38 is less than the length of the threads 40 along the central axis of the recess 38, and the threaded portion 60 when in the orientation shown in FIG. 1 does not extend across the vents 44. To this end, the axial length of the threaded portion 60 is less than the overall axial length of the threads 76 of the plug 74.

The spray dispensing operation begins after the spray head 52 is connected to an air gun handle and the control valve on the air gun handle is opened to admit pressurized air into the venturi insert 66. The flow of pressurized air establishes negative pressure conditions in the body 58 and the suction tube 46, causing liquid material to be drawn from the chamber 24 and mixed with air as the air exits the insert 66, and then be discharged through the outlet 68 in the form of a spray. As liquid material is withdrawn from the container 12, atmospheric air is admitted into the chamber 24 along a path through the space between the plate 64 and the flange 28, then along the space between the tubular body 58 and the sidewalls of the recess 38 until entering the chamber 24 through the vents 44.

If the outlet 68 becomes clogged, pressurized air admitted into the spray head 52 might enter the chamber 24 through the suction tube 46. In such instances, the plate 64 serves as a shield to deflect liquid material escaping through the vents 44 away from the user's face. The plate 64 also provides additional stability to the assembly 10, since the plate 64 extends over the flange 28 in closely spaced relation and blocks excessive rocking or tilting of the spray head 52 relative to the longitudinal axis of the container 12. A pair of opposed notches 80 in the plate 64 provide secondary pressure relief if needed.

At the end of a dispensing operation, the spray head 52 is detached from the air gun handle. If the container 12 is empty, both the spray head 52 and the container 12 can be disposed together without disassembly and without the need for cleaning the inexpensive spray head 52. On the other hand, if the container 12 is not empty, the spray head 52 is unthreaded from the cap 26, and the plug 74 is re-threaded into the recess 38 in order to seal the container 12 and hinder spilling or curing of the liquid contents. The spray head 52 can then be stored in cleaning material in readiness for the next use.

The internal suction tube 46 and the captive cap 26 substantially deter refilling of the chamber 24 with additional liquid material and thus reduce the risk that the container 12 might contain a material different from the material identified on the container's label. It is possible to attempt to refill the chamber 24 by pouring material from a bulk container into the recess 38, but such an attempt is greatly hindered due to the proximity of the lower second end portion 50 of the tube 46 with the bottom of the chamber 24 and also due to the relatively small area of the vents 44.

Advantageously, the container 12 is relatively inexpensive to procure, fill and ship, and the coupling 63 enables the assembly 10 to be shipped and stored in relatively compact fashion. Additionally, the coupling 63 enables the user to replace only the spray head 52 and save remaining material in the can 14 if the entire contents of the can 14 are not dispensed. The provision of the coupling 63 also enables the manufacturer to vary the diameter of the threads 40 and threaded portion 60 (along with the threads 76) so that certain spray heads are used only with certain containers, an advantage because the manufacturer can then select a spray head that provides specific spray characteristics for particular material sold in the matching container.

We claim:

1. A spray dispensing assembly for liquid materials comprising:

a container having a chamber with an opening;

a captive cap non-releasably connected to said container and extending across said opening, said captive cap including a hole;

a spray head having a first inlet with a connection for detachable joining with a source of pressurized air, a second inlet for liquid material and an outlet for discharging a spray of liquid material;

a coupling for coupling said second inlet of said spray head to said hole of said captive cap, said coupling including a threaded portion complemental to said threads of said captive cap for securing said spray head to said container; and a tube in said chamber, said tube having a first end portion located in said chamber at a position remote from said captive cap, said tube having a second end portion fixed to said captive cap next to said hole for communication with said second inlet of said spray head.

2. The assembly of claim 1, wherein said cylindrical wall presents a recess leading to said hole, and wherein said second end portion of said tube surrounds said cylindrical wall.

3. The assembly of claim 2, wherein the internal diameter of said second end portion of said tube is normally smaller than the diameter of said wall for press-fit engagement with the latter.

4. The assembly of claim 1, wherein said container has a bottom, and wherein said first end portion of said tube is next to said bottom.

5. The assembly of claim 1, wherein said spray head includes a tubular body, and wherein said threaded portion is located on said tubular body.

6. The assembly of claim 1, wherein said captive cap includes a crimp for non-releasably connecting said captive cap to said container.

7. The assembly of claim 1, wherein said spray head includes a tubular body presenting said second inlet and also includes an outwardly extending plate extending across said captive cap when said spray head is coupled to said captive cap.

8. The assembly of claim 1, wherein said coupling is a releasable coupling.

9. A spray dispensing assembly for liquid materials comprising:

a container having a chamber with an opening;

a captive cap non-releasably connected to said container and extending across said opening, said captive cap including a hole;

a spray head having a first inlet with a connection for detachable joining with a source of pressurized air, a second inlet for liquid material and an outlet for discharging a spray of liquid material and an outlet for discharging a spray of liquid material;

a coupling for coupling said second inlet of said spray head to said hole of said captive cap; and a tube of said chamber said tube having a first end portion located in said chamber at a position remote from said captive cap, said tube having a second end portion fixed to said captive cap next to said hole for communication with said second inlet of said spray head, wherein said captive cap includes a recess having a vent located in said recess, wherein said recess includes threads, and wherein said vent extends through said threads.

10. A spray dispensing combination for liquid materials comprising:

a container having a chamber for containing a quantity of liquid material;

an outlet hole leading to said chamber for withdrawing liquid material from said chamber;

a vent for communicating said chamber with the atmosphere;

a spray head having a first inlet for communication with a source of pressurized air, a second inlet for liquid material and an outlet for discharging a spray of liquid material;

a coupling for coupling said second inlet of said spray head to said hole; and means for selectively closing said hole when said second inlet of said spray head is not connected to said hole, said means including structure for covering said vent when said hole is closed, wherein said means comprises a plug.

11. The combination of claim 10, wherein said coupling comprises a threaded portion connected to said spray head and threads connected to said container.

12. The combination of claim 10, wherein said structure comprises threads.

13. The combination of claim 12, wherein said coupling includes threads connected to said container; and including a cap connected to said container, said cap including a recess, and wherein said threads connected to said container are located in said recess of said cap.

14. The combination of claim 13, wherein said cap includes a cylindrical wall presenting said recess; and including a tube in said chamber having an end portion secured to said wall.

15. A spray dispensing combination for liquid materials comprising:

a container having a chamber;

a coupling having threads connected to said container;

a vent extending through said threads for communicating said chamber with the atmosphere;

a plug having threads complemental to said threads connected to said container, said threads of said plug being of a length sufficient to cover said vent when said threads of said plug are fully threaded into said threads connected to said container; and a spray head having a tubular body with a threaded portion complemental to said threads connected to said container, said threaded portion being of a length less than the threads of said plug and spaced from said vent when said threaded portion is fully threaded into said threads connected to said container.

16. The combination of claim 15, wherein said container has an opening; and including a cap connected to said container and extending across said opening, wherein said cap includes a recess having said threads connected to said container.

17. The combination of claim 16, wherein said cap is non-releasably connected to said container.

18. The combination of claim 17, wherein said cap includes a crimp for non-releasably connecting said cap to said container.

19. A spray dispensing combination for liquid material comprising:

a container having a chamber for containing a quantity of liquid material;

a neck connected to said container, said neck having threads and an outlet hole leading to said chamber for withdrawing liquid material from said chamber, said neck having a vent extending through said threads for communicating said chamber with the atmosphere;

a spray head having a first inlet for communication with a source of pressurized air, a second inlet for liquid material and an outlet for discharging a spray of liquid material, said spray head including a threaded portion complemental to said threads of said neck for coupling said second inlet of said spray head to said hole, said threaded portion being spaced from said vent to enable said chamber to communicate with the atmosphere when said threaded portion is fully threaded onto said threads of said neck; and means for selectively closing said hole when said second inlet of said spray head is not connected to said hole, said means including threads complemental to said threads of said neck and covering said vent when said hole is closed.

* * * * *

UNITED STATES PATENT AND TRADEMARK OFFICE

CERTIFICATE OF CORRECTION

PATENT NO. : 5,180,109

DATED : January 19, 1993

INVENTOR(S) : Neil J. Schwartzbauer and Douglas J. Laska

It is certified that error appears in the above-identified patent and that said Letters Patent is hereby corrected as shown below:

Col. 1, line 22, "i" should be -- in --.

Col. 5, line 46, after "cap" insert -- including a cylindrical wall having threads, said wall --.

Col. 6, line 28, delete "and an outlet for discharging a spray of liquid material".

Col. 6, line 32, "of" should be -- in --.

Signed and Sealed this

Twenty-fifth Day of January, 1994

*Attest:*

Bruce Lehman

BRUCE LEHMAN

*Attesting Officer*

*Commissioner of Patents and Trademarks*